US009609725B2

(12) United States Patent
Bosua et al.

(10) Patent No.: US 9,609,725 B2
(45) Date of Patent: Mar. 28, 2017

(54) CONTROLLABLE LIGHTING DEVICES

(71) Applicant: LIFI Labs, Inc., Richmond, Victoria (AU)

(72) Inventors: Phillip Bosua, Victoria (AU); Andrew Gelme, Victoria (AU)

(73) Assignee: LIFI Labs, Inc., San Francisco, CA (US)

( * ) Notice: Subject to any disclaimer, the term of this patent is extended or adjusted under 35 U.S.C. 154(b) by 10 days.

(21) Appl. No.: 14/425,266

(22) PCT Filed: Sep. 6, 2013

(86) PCT No.: PCT/AU2013/001015
§ 371 (c)(1),
(2) Date: Mar. 2, 2015

(87) PCT Pub. No.: WO2014/040118
PCT Pub. Date: Mar. 20, 2014

(65) Prior Publication Data

US 2015/0271899 A1 Sep. 24, 2015

Related U.S. Application Data

(60) Provisional application No. 61/697,749, filed on Sep. 6, 2012.

(51) Int. Cl.
*H05B 37/02* (2006.01)
*H05B 33/08* (2006.01)

(52) U.S. Cl.
CPC ..... *H05B 37/0272* (2013.01); *H05B 33/0857* (2013.01); *H05B 33/0863* (2013.01)

(58) Field of Classification Search
CPC H05B 37/02; H05B 33/0857; H05B 33/0863; H05B 37/0272
USPC ..... 315/297, 307, 312
See application file for complete search history.

(56) References Cited

U.S. PATENT DOCUMENTS

| | | | |
|---|---|---|---|
| 4,942,386 | A | 7/1990 | Willis |
| 5,769,527 | A | 6/1998 | Taylor et al. |
| 5,841,428 | A | 11/1998 | Jaeger et al. |
| 6,759,966 | B1 | 7/2004 | Weng |
| 7,339,128 | B2 | 3/2008 | Yen |
| 7,418,392 | B1 | 8/2008 | Mozer et al. |
| 7,446,671 | B2 | 11/2008 | Giannopoulos et al. |
| 7,474,632 | B2 | 1/2009 | Ban |
| 7,598,885 | B2 | 10/2009 | Kwon et al. |
| 7,884,556 | B2 | 2/2011 | Gandhi |
| 7,980,726 | B2 | 7/2011 | Joosen et al. |
| 8,195,313 | B1 | 6/2012 | Fadell et al. |
| 8,253,344 | B2 | 8/2012 | Guest et al. |

(Continued)

FOREIGN PATENT DOCUMENTS

CN 203099410 U 7/2013

*Primary Examiner* — Tung X Le
(74) *Attorney, Agent, or Firm* — Jeffrey Schox; Diana Lin

(57) ABSTRACT

The present invention provides a lighting device comprising a light output means, a computing device, data communication means, and a casing, wherein the light output means is configured to be controllable by the computing device, the computing device configured to receive and/or transmit instructions to/from the data communication means. The lighting device may be capable of outputting light have various effects, or may emit notifications to a user.

16 Claims, 5 Drawing Sheets

(56) References Cited

U.S. PATENT DOCUMENTS

| | | | | |
|---|---|---|---|---|
| 8,282,250 | B1 | 10/2012 | Dassanayake et al. | |
| 8,294,379 | B2 | 10/2012 | Liu et al. | |
| 8,523,410 | B2 | 9/2013 | Hashimoto et al. | |
| 8,562,158 | B2 | 10/2013 | Chien | |
| 8,581,512 | B2 | 11/2013 | Hamamoto et al. | |
| 8,742,694 | B2 | 6/2014 | Bora et al. | |
| 8,755,561 | B2 | 6/2014 | Vlutters et al. | |
| 8,760,514 | B2 | 6/2014 | Chien | |
| 8,764,251 | B2 | 7/2014 | Lien | |
| 8,812,827 | B2 | 8/2014 | Malasani | |
| 8,820,984 | B2 | 9/2014 | Gillio | |
| 2007/0182367 | A1 | 8/2007 | Partovi | |
| 2008/0218099 | A1 | 9/2008 | Newman | |
| 2009/0295310 | A1 | 12/2009 | Duerr et al. | |
| 2010/0068899 | A1 | 3/2010 | Shvili | |
| 2010/0296285 | A1* | 11/2010 | Chemel | F21S 2/005 362/235 |
| 2011/0050120 | A1 | 3/2011 | Leung et al. | |
| 2011/0089838 | A1 | 4/2011 | Pickard et al. | |
| 2011/0163683 | A1 | 7/2011 | Steele et al. | |
| 2011/0234366 | A1* | 9/2011 | Feng | G08C 17/02 340/3.1 |
| 2011/0285515 | A1 | 11/2011 | Fushimi et al. | |
| 2011/0309769 | A1* | 12/2011 | Kuroki | H05B 37/0272 315/294 |
| 2012/0025717 | A1 | 2/2012 | Klusmann et al. | |
| 2012/0080944 | A1* | 4/2012 | Recker | H02J 9/02 307/25 |
| 2012/0126699 | A1 | 5/2012 | Zittel | |
| 2012/0195053 | A1 | 8/2012 | Wu | |
| 2012/0300441 | A1 | 11/2012 | Thomas et al. | |
| 2013/0038230 | A1 | 2/2013 | Brown et al. | |
| 2013/0063042 | A1 | 3/2013 | Bora et al. | |
| 2013/0148341 | A1 | 6/2013 | Williams | |
| 2013/0193847 | A1 | 8/2013 | Recker et al. | |
| 2014/0043825 | A1 | 2/2014 | Brandes et al. | |
| 2014/0285999 | A1 | 9/2014 | Luna et al. | |
| 2015/0015165 | A1* | 1/2015 | Engelen | H04B 10/1143 315/294 |
| 2016/0100086 | A1 | 4/2016 | Chien | |

* cited by examiner

CONTROLLABLE LIGHTING DEVICES

FIELD OF THE INVENTION

The present invention is directed generally to lighting devices useful for providing ambient lighting in domestic and commercial premises. More particularly, the invention is directed to lighting devices having parameters that are controllable by a user.

BACKGROUND TO THE INVENTION

Light bulbs and other lighting means are an essential part of domestic and business premises. Ambient illumination is currently provided predominantly by incandescent light bulbs, halogen down lights, compact fluorescent globes, and more recently light emitting diode (LED) or solid state lighting, SSD.

Various techniques are used for controlling light bulbs at present but the vast majority are controlled via a wall switch, which may or may not include additional features such as a dimmer.

LED bulbs are becoming more commonplace in households and businesses alike, due to decreasing costs, energy efficiency and long lifespan relative to incandescent and compact fluorescent bulbs.

While technologically superior, prior art LED light bulbs are difficult to control. For example, many types of LED are not controllable by a standard dimmer. It is also difficult to control groups of LED lights as a single functional unit.

It is an aspect of the present invention to provide lighting devices and systems to facilitate the customization of light provided to a user's environs. It is a further aspect to provide an alternative to prior art lighting devices and systems.

The discussion of documents, acts, materials, devices, articles and the like is included in this specification solely for the purpose of providing a context for the present invention. It is not suggested or represented that any or all of these matters formed part of the prior art base or were common general knowledge in the field relevant to the present invention as it existed before the priority date of each provisional claim of this application.

SUMMARY OF THE INVENTION

After considering this description it will be apparent to one skilled in the art how the invention is implemented in various alternative embodiments and alternative applications. However, although various embodiments of the present invention will be described herein, it is understood that these embodiments are presented by way of example only, and not limitation. As such, this description of various alternative embodiments should not be construed to limit the scope or breadth of the present invention. Furthermore, statements of advantages or other aspects apply to specific exemplary embodiments, and not necessarily to all embodiments covered by the claims.

Throughout the description and the claims of this specification the word "comprise" and variations of the word, such as "comprising" and "comprises" is not intended to exclude other additives, components, integers or steps.

Reference throughout this specification to "one embodiment" or "an embodiment" means that a particular feature, structure or characteristic described in connection with the embodiment is included in at least one embodiment of the present invention. Thus, appearances of the phrases "in one embodiment" or "in an embodiment" in various places throughout this specification are not necessarily all referring to the same embodiment, but may.

In a first aspect the present invention provides a lighting device comprising a light output means,
a computing device,
data communication means, and
a casing, wherein the light output means is configured to be controllable by the computing device, the computing device configured to receive and/or transmit instructions to/from the data communication means.

In one embodiment the light output means, the computing device, and the data communication means are disposed substantially within the casing.

In one embodiment the data communication means is incorporated into the computing device.

In one embodiment the data communication means is a wireless networking means.

In one embodiment the wireless networking means is configured to be operable in a wireless networking protocol.

In one embodiment the wireless networking protocol is a WiFi protocol.

In one embodiment the wireless networking protocol is a mesh networking protocol.

In one embodiment the wireless networking protocol is a WiFi protocol and a mesh networking protocol.

In one embodiment the wireless networking protocol is a WiFi protocol.

In one embodiment the light output means comprises one or more light emitting diodes.

In one embodiment the light output means is configured to emit light of predetermined wavelengths.

In one embodiment the lighting device comprises two or more light output means, the two or more light output means configured to emit different light spectra, wherein the different light spectra mix to provide a predetermined light spectrum.

In a second aspect, the present invention provides a user computing device configured to control a lighting effect of a lighting device as described herein.

In one embodiment of the user computing device the lighting effect is light color.

In a third aspect the present invention provides a system for controlling lighting, the system comprising one or more lighting devices as described herein, and
data communication means configured to transmit an instruction to the one or more lighting devices.

The system may further comprise a user computing device as described herein

DETAILED DESCRIPTION OF THE INVENTION

Figure 1:
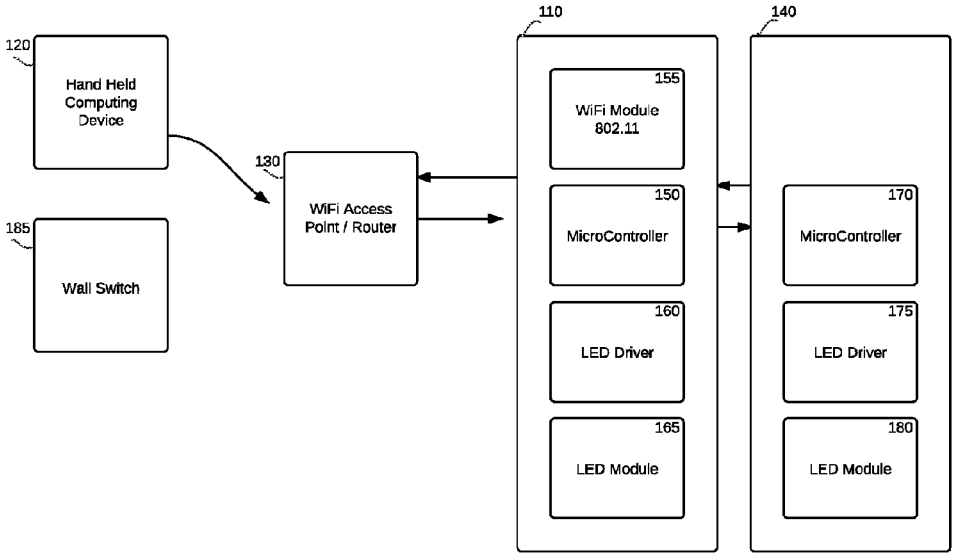
FIG. 1 is a block diagram of a system for controlling lighting devices via a handheld computing device and wireless 802.15.4 mesh networking.

The lighting devices subject the present invention comprise a computing device and data communication means, the combination of these features allowing for the control of light output by the device.

As used herein, the term "lighting device" is intended to include any device capable of emitting light in a controllable manner. The device may be configured substantially as a light bulb to be inserted into an existing light fitting (such as a GU10, bayonet cap, Edison screw fitting, MR16, G4, or G9). Alternatively the device may be wired directly into the wiring of a building, and may comprise custom or dedicated mounting or installation hardware.

Preferably, however, the lighting device is configured to replace a standard lighting fitting thereby allow for the advantages of the present invention without the need to modify the existing electrical circuits of a building.

The lighting output means includes any device capable of emitting light in the spectrum visible to humans, and is typically a light emitting diode (LED) or similar technology.

The computing device may be any electronic device capable of receiving data input, transforming that data, a providing data output. The computing device is typically (although not exclusively) a microprocessor or microcontroller generally being an onboard component that is designed and miniaturized from a circuit schematic, and then programmed via firmware to achieve a desired result. Exemplary microcontrollers in the context of the present lighting devices include the ATMEGA128RFA1-ZU (IC AVR MCU 2.4 GHZ XCEIVER 64QFN; Digikey Corporation Minn., USA), and CC2538SF53 (Texas Instruments, Tex. USA).

The skilled person is enabled to select other microcontrollers or microprocessors capable of receiving and/or transmitting instructions to/from the data communication means. The computing device may also have a role in transmitting instructions to the light output means, optionally by way of a hardware or software driver.

The data communication means may be any electronic device capable of receiving data originating external to the lighting device (and typically transmitted by a user seeking to control the lighting device), and transmitting that data to the computing device and/or light output means. The data transmission may be direct or indirect to the computing device or light output means.

The data communication means may be wireless in nature, and thereby typically having an antenna. The communications means may operate on any type of electromagnetic radiation, however generally operates by radio wave. Non wireless data communication means are also contemplated to operate by means other than wireless and may exploit the existing power supply wiring of the building.

Advantageously the light output means, the computing device and the data communication means are disposed substantially within the casing of the lighting device. This provides for a unitary device which can be simply and easily retrofitted to an existing lighting fitting.

In one embodiment, the lighting device includes within the casing means for shielding temperature sensitive components (such as a microprocessor, microcontroller or WiFi chip) from heat generated by the light output means.

It will be appreciated that various spatial constraints may dictate the external dimensions of the unitary lighting device, one being the fitting at the base designed to draw power. Other dimensional constraints may be applicable especially for lighting devices configured to fit within confined spaces, such as those of down light fittings (MR16 fittings for example).

The wireless networking means may be operable in the context of a wireless networking protocol. The protocol (which may be an existing protocol, or a custom protocol) allows for the wireless networking means to extract data from a radio signal originating external to the lighting device. Typically, the data will be an instruction to set or alter a lighting effect of the lighting device.

In one embodiment, the wireless protocol is a wireless network protocol. The present invention allows for the establishment of a data network between a lighting device and a remote user device (such as a computer, a router, or a smart phone).

In some forms of the invention, the protocol allows for the interchange of data between two or more lighting devices. This allows for master/slave configurations such that a single master lighting device receives instructions, and then transmits those instructions as required to a plurality of slave lighting devices. It will be understood that a master/slave configuration is not an essential feature of the present invention, and that the protocol may operate by transmitting data directly to each lighting device independently.

To provide for ease of installation and operation, the wireless protocol may be any standard protocol that may be implemented in an existing wireless network of a building. In one embodiment, the protocol is a WiFi protocol (including IEEE™ 802.11 legacy/a/b/g/n/ac/ad). Thus, the lighting devices a configured to join an existing WiFi network in a manner the same or similar to that for WiFi capable devices such as a smart phone, a laptops, a tablet or a personal computer.

Alternatively or in combination with the WiFi protocol, the present lighting devices may be configured to be operable within a mesh networking protocol.

The term "mesh network", generally refers to a communications network made up of radio nodes organized in a mesh topology. Wireless mesh networks often consist of mesh clients, mesh routers and gateways. The mesh clients are often laptops, cell phones and other wireless devices while the mesh routers forward traffic to and from the gateways which may but need not connect to the Internet. The mesh network of some embodiments of the invention describes the relationship between the clients (which are the lighting devices), and may be an IPV6 802.15.4 network.

Other potentially operable networking protocols for routing packets across mesh networks, include, AODV (Ad hoc On-Demand Distance Vector), B.A.T.M.A.N. (Better Approach To Mobile Adhoc Networking), Babel (protocol) (a distance-vector routing protocol for IPv6 and IPv4 with fast convergence properties), DNVR (Dynamic Nix-Vector Routing), DSDV (Destination-Sequenced Distance-Vector Routing), DSR (Dynamic Source Routing), HSLS (Hazy-Sighted Link State), HWMP (Hybrid Wireless Mesh Protocol), IWMP (Infrastructure Wireless Mesh Protocol) for Infrastructure Mesh Networks by GRECO UFPB-Brazil, MRP (Wireless mesh networks routing protocol) by Jangeun Jun and Mihail L. Sichitiu, OLSR (Optimized Link State Routing protocol), OORP (OrderOne Routing Protocol) (OrderOne Networks Routing Protocol), OSPF (Open Shortest Path First Routing), PWRP (Predictive Wireless Routing Protocol), TORA (Temporally-Ordered Routing Algorithm), and IEEE™ 802.15.4 (ZigBee) IEEE™ 802.15.4. Such protocols may be used as a basis for a protocol workable within the context of the present methods, with the skilled person being enabled to do so.

Exemplary WiFi/mesh Protocols Include IEE™ 802.11s and 802.15.4.

In one embodiment, WiFi and mesh protocols are used in combination. The WiFi protocol provides connectivity to a typical home network from popular devices already in the possession of many consumers. The mesh protocol provides a more apt use for the data transfer due to its mesh capabilities. e.g. the more mesh nodes/devices there are the stronger and more reliable the network becomes. This suits a multi device wireless system as is the present case. Mesh device may also transmit and receive data between each other (and directly) rather than constantly referring back to a single source.

In some embodiments, the network is accessible to the Internet thereby allowing a user to control the lighting devices when off site.

The light output means is typically a LED, or a number of LEDS. Where the present lighting devices are configured to output light of a predetermined color, the light output means may comprise a red, a green and a blue LED. The light output of these three LEDS may be independently altered to create a light output having a desired colour.

From the above, it will be appreciated that the present lighting devices may be operable remotely by a user. Typically, the user sends instructions to the lighting device(s) via a network to set or alter a lighting effect. Such effects include light color, light level (continuous and also on/off states), strobing effects, pulsating effects, energy saving effects and the like.

The user generally instructs these effects by way of a user computing device which is configured to send instructions to the lighting device. The user computing device may be a smart phone, a lap top, a tablet or a personal computer. Preferably, the device is a hand-held device such as a smart phone or tablet. The user is capable of setting or altering a lighting effect from a settled position, such as while reading or watching television.

The user computing device comprises software (such as an app) which presents an interface to the user allowing for the setting or altering of a lighting effect. The software is configured to instruct the computing device to transmit data to the lighting device to achieve the desired lighting effect.

The interface may present to the user a range of colors achievable in visual form, optionally by way of an arc or circle displaying colours discretely or in the form of a continuous spectrum. Where the interface is presented on a touch screen, the user is enabled to touch a desired color or color region. Whichever method is used to select a desired output light color, the user computing device transmits data to the lighting device, typically in the form a data packet across a data network. The lighting device is configured to receive the data, and adjust the light output means to output the desired color. Typically the desired color is generated by separately modulating the output of a red, green and blue LED.

It will be appreciated that the present lighting devices may be operable as part of a system for controlling lighting. The system includes one or more of the present lighting devices, and data communication means configured to transmit an instruction control the one or more lighting devices. The data communication means may be wired or wireless means as discussed more fully supra.

The present lighting devices and/or user computing device may operate alone or in combination to provide for one or more lighting effects. Lighting effects may be additional capabilities of the light to perform specific tasks as directed by the user interface, for example, dimming during a specified period of minutes, slowly brightening from dark to full intensity during a specified period of minutes, or strobing or pulsing.

The present lighting devices and/or user computing device may operate alone or in combination to provide for one or more lighting notifications. A notification may rely on the use of light from a present lighting device to signify a change in the environment or an event detected by the handheld computing device, and/or being derived directly from the Internet or local network, for example a text message, email, weather change, Facebook™ message, Tweet™ or another custom event. The notification may be represented by a flash of light of any length, or a color change of the light output means, or a pulsing of light intensity of the light output means. Various combinations of light output modulation may be used to communicate a plurality of messages to the user, optionally similar to that utilized by Morse code but with short and long displays of light.

DESCRIPTION OF PREFERRED EMBODIMENTS

Figure 5:
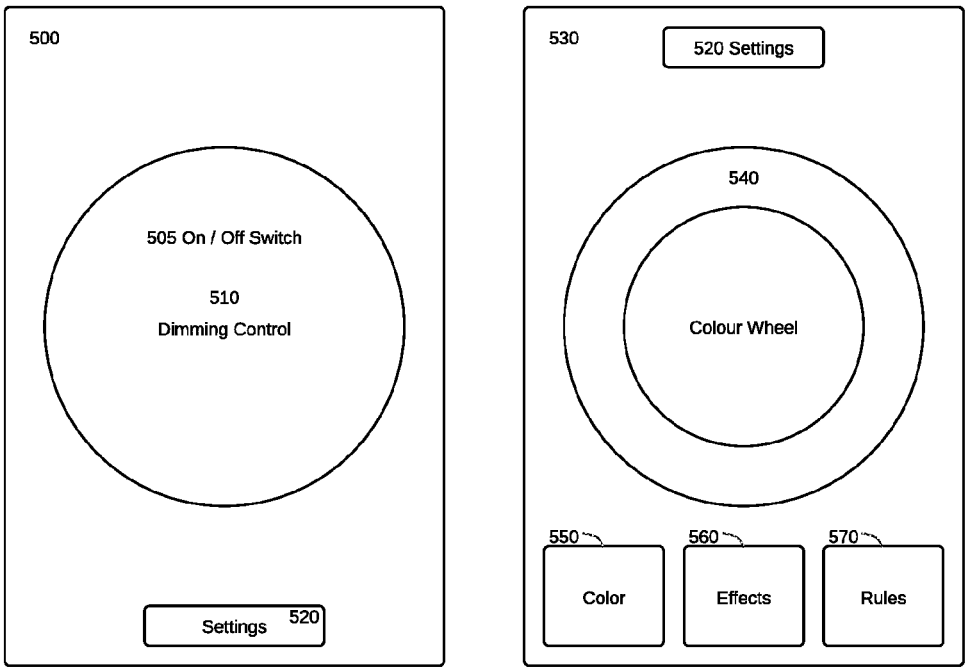
FIG. 5 is a diagram of user interface elements configured to control lighting devices(s) and system via a handheld computing device.

The system of the present invention may comprise a group of individual components operating as a system for the control and configuration of a LED light bulb or series of LED light bulbs. Principally these components include a master bulb (FIG. 2), a slave bulb (FIG. 3), a wireless network, a mesh network, a handheld computing device, and a user interface (FIG. 5).

Figure 4:
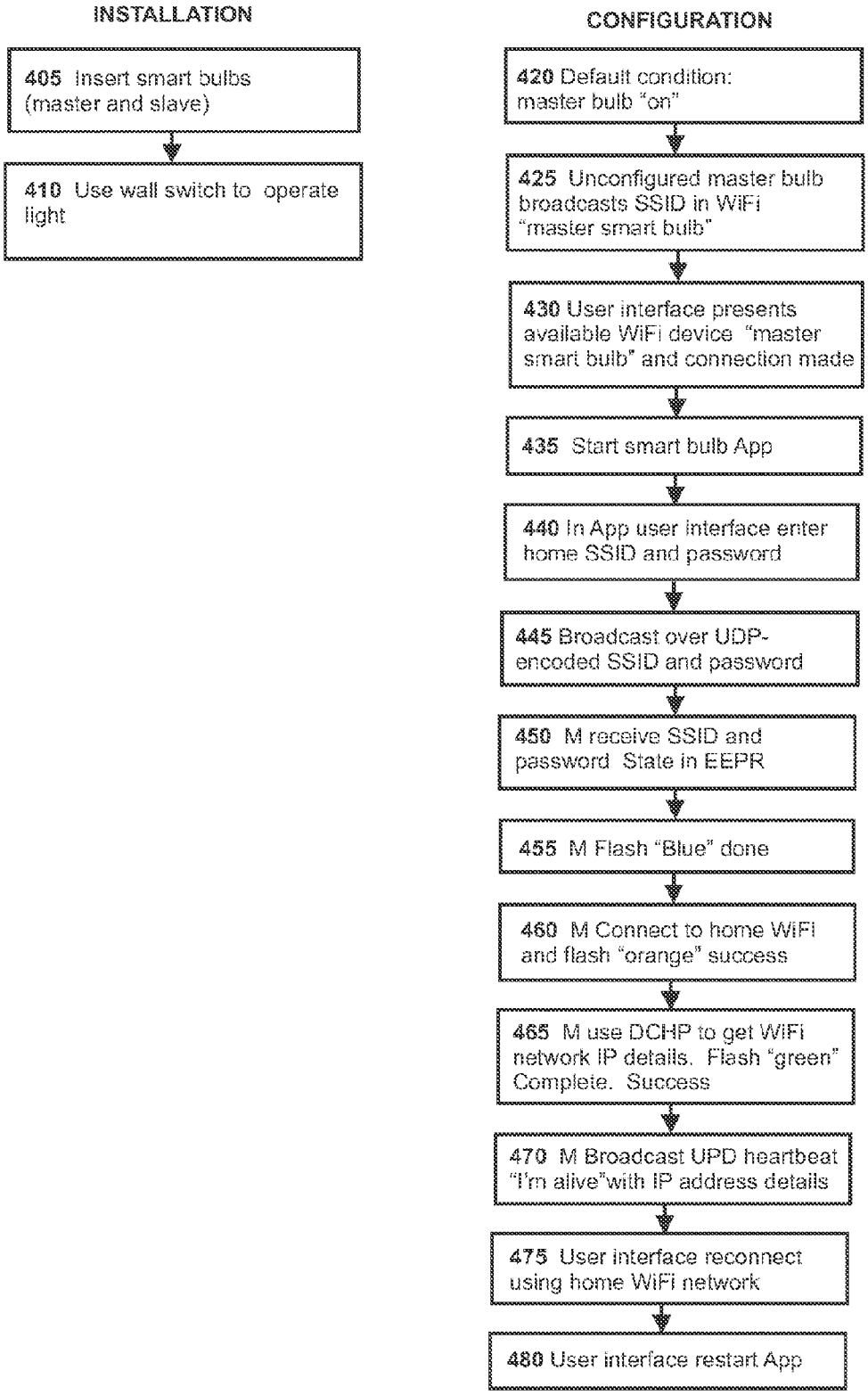
FIG. 4 is a flow chart showing operation of software on a handheld computing device configured to control a lighting system having a master lighting device.

For operability of the system, a configuration process may be required (FIG. 4)

The bulbs are LED RGB configured bulbs, having custom components such as a WiFi controller chip, antenna and microprocessor to receive inputs and signals from the user via the user interface. The possible advantages of this system are custom color configurations; the ability to create groups of lights; the ability to create lighting effects described herein above, and to remotely turn light bulbs on or off; set lights to turn on or off based on timers; select color codes, or dim lights to many different colour temperatures. This system can be controlled locally via the wireless 802.11 network, or remotely via the Internet.

In one embodiment, the color code is a digit, and typically a hexadecimal digit which represents four binary digits (bits). An advantage of using hexadecimal notation in this context is that this notation is easily read by humans to represent binary-coded values in computing and digital electronics. One hexadecimal digit represents a nibble, which is half of an octet (8 bits). For example, byte values can range from 0 to 255 (decimal), but may be more conveniently represented as two hexadecimal digits in the range 00 to FF forming a 16 million colour palette.

Phosphor-based LEDs are particularly suited because they provide a broad spectrum of light, however it is understood the present will be operable with other types of LEDs.

Reference is now made to FIG. 1 which illustrates one embodiment of the present lighting system and the components used to form that system including novel components (the master bulb; the slave bulb and the user interface) and known components (the wireless network and the hand-held computing device).

110 represents the 802.11 wireless controller chipset that is contained within the master bulb. The components 150 MicroController, 160 LED driver, 165 LED Module are included in the master bulb. 120 represents the handheld device, for example an iPhone™, iPad™, Android™ or other handset or tablet.

130 represents the wireless access point, also referred to as the router, the WiFi, or the wireless network. 140 represents the slave bulb, and the individual component is described as 170, 175 and 180. The diagram also shows a wall switch, 185, that can be added to the system to allow manual override of the user interface for standard control.

Figure 2:
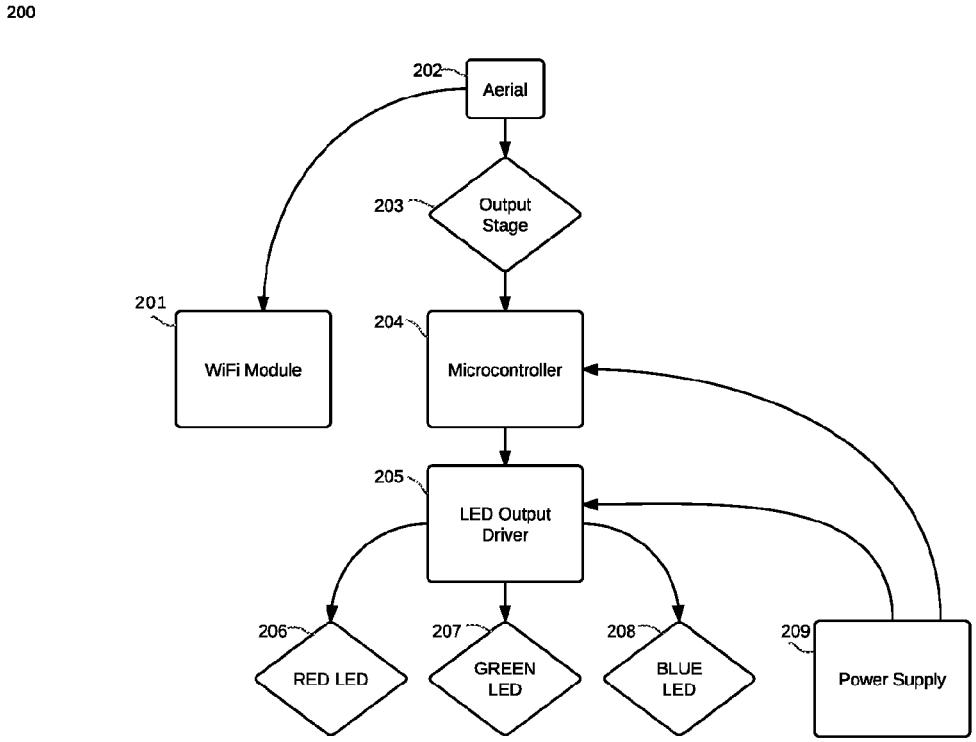
FIG. 2 is block diagram of a master lighting device which is controllable with a handheld computing device via a user interface and a wireless network.

FIG. 2 shows a block diagram of the components used within the master bulb, including the WiFi Controller Chip, 201, the aerial 202, the output stage 203, the Micro Controller 204, the LED driver 205, the power supply 206 and the RGB LED lights, 207, 208, 209 for Red, Green and Blue respectively and 210 for the connection, or light cap, that connects to the light fitting and the electrical current. This cap can be either a bayonet cap, an Edison screw, or a down light.

Figure 3:
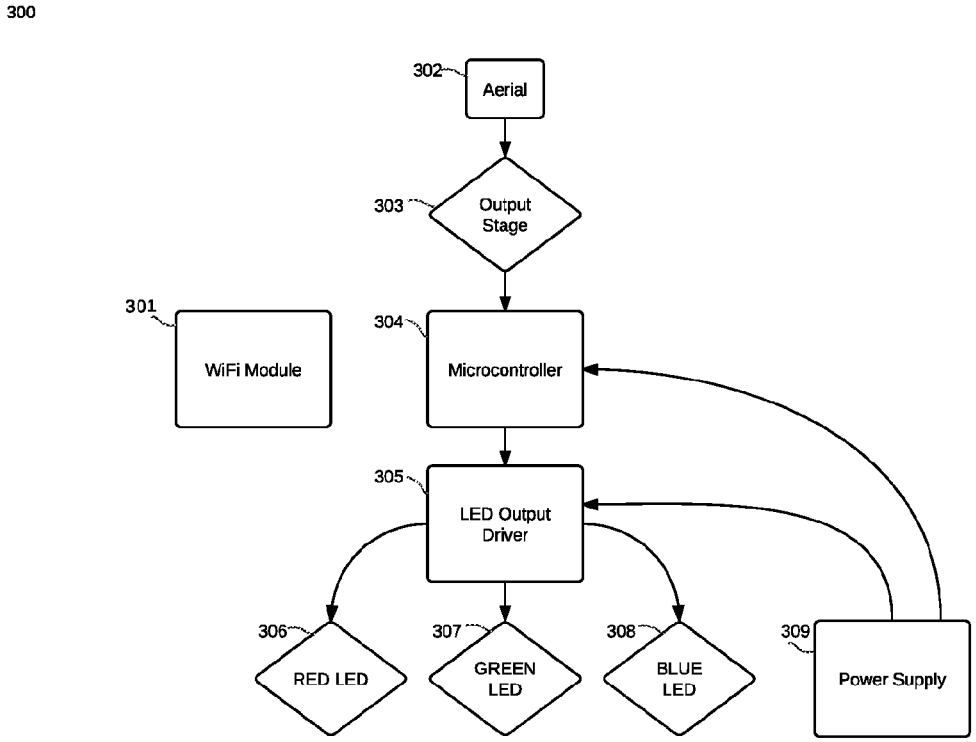
FIG. 3 is block diagram of a slave lighting device which is controllable by a handheld computing device, and a master bulb via 802.15.4 wireless mesh network.

FIG. 3 shows a block diagram of the components used with the slave bulb, including the aerial 303, the output stage 304, the Microcontroller 305, the LED driver 306, the power supply 307, and the RGB LED lights 308, 309, 310 for Red, Green and Blue respectively and 311 for the connection, or light cap, that connects to the light fitting to the power supply.

Together the master and the slave bulbs form a 802.15.4 mesh network that is controlled via the hand held computing device 120.

FIG. 4 is a flow chart of the configuration process that enables the user interface to be paired and then control the lights. The steps described in the process are outlined as 405, insert bulb, which is the process of inserting or screwing the present bulb into the socket ready for operation.

410 Using wall switch to operate normal light. This process is referring to default behaviour of the invention, which operates in a manner like a normal light bulb, in that it turns on and off at the control of a wall switch. Setting the wall switch to on is the process described in 410.

420 describes the process of leaving the master bulb 200 on. This enables the master bulb to communicate with the wireless router, and the slave bulbs using the 802.15.4 mesh network. 425 describes the process of the unconfigured master bulb, that once given access to the wireless network via a SSID becomes the controllable master bulb via the user interface. The SSID is defined as a Service Set Identifier, the SSID is a unique identifier that consists of 32 characters used for indentifying wireless networks.

The SSID may facilitate connection of the master bulb to the wireless device in this embodiment of the invention. Alternative methods of connection are of course contemplated, including those yet to be described.

430 describes that the user interface searches for wireless networks and connects to the master bulb. This configuration process is enabled by steps outlined as 435, 440 and 445 in which the user interface, described in 435 as the App prompts the operator to enter the SSID and password to enable pairing and the preparation for controlling lights via the handheld computing device and user interface.

Once this has been configured this is broadcast over UDP encoded SSID, and therefore, the master bulb and the user interface are ready for operation by the user. The master bulb receives the confirmation and flashes to indicate, done, which signifies the first step in pairing the devices is complete, outlined as 455.

Following this the process are steps 465, 470, 475, 480 which finalises this pairing by flashing to signify pairing is finalised. 470 is the master bulb letting the interface know that is now paired and alive, meaning that it is now controllable via the user interface by the user.

FIG. 5 is a collection of block diagrams of the application design and the numbers represent the features that are described that enable the user to send specific signals and tasks to the lights.

500 is a block diagram of the first screen of the user interface. The diagram contains 505 which is the on/off switch controlled by the user, by pressing or tapping the middle button, which toggles the state of the light on/off. 510 which is a controllable wheel that lets the user move clockwise or anti-clockwise to alter the intensity of the lights controlled by the present system. 520 is a settings tab that opens the next part of the application referred to herein as 530. 530 shows four distinct aspects of the user interface that enable the operator of the handheld device to interact with the present light bulbs in distinct ways. 540 is a color wheel, that enables the user to control the exact color code of the master and slave bulbs.

550 returns users to screen 530 when pressed. 560 takes the user to an effects page where there are additional settings that allow a user to create specific effects with their lights, including but not limited to strobing effects; and music visualisation, which is an effect that enables the lights to change color and intensity in a co-ordinated or ad hoc pattern based on music played by the user via their handheld device or another sound source.

570 takes the user to another screen, referred to herein as rules. Rules are specific settings a user can enable that cause the master and slave bulbs to behave with certain characteristics, including but not limited to, a mode for reducing energy consumption known as power save mode; and auto on and off modes that use the handheld computing devices location to detect whether to turn lights on or off, for example, a setting that turns all lights off once the handheld computing device is out of range of the wireless network.

The systems and methodologies described herein are, in one embodiment, performable by one or more processors that accept computer-readable (also called machine-readable) code containing a set of instructions that when executed by one or more of the processors carry out at least one of the methods described herein. Any processor capable of executing a set of instructions (sequential or otherwise) that specify actions to be taken are included. Thus, one example is a typical processing system that includes one or more processors. Each processor may include one or more of a CPU, a graphics processing unit, and a programmable DSP unit. The processing system further may include a memory subsystem including main RAM and/or a static RAM, and/or ROM. A bus subsystem may be included for communicating between the components.

The processing system further may be a distributed processing system with processors coupled by a network and could be a virtual processing system or a cloud based processing system.

If the processing system requires a display, such a display may be included, e.g., a liquid crystal display (LCD) or a cathode ray tube (CRT) display. If manual data entry is required, the processing system also includes an input device such as one or more of an alphanumeric input unit such as a keyboard, a pointing control device such as a mouse or a touch screen, and so forth.

The term memory unit as used herein, if clear from the context and unless explicitly stated otherwise, also encompasses a storage system such as a disk drive unit. The processing system in some configurations may include a sound output device, and a network interface device. The memory subsystem thus includes a computer-readable carrier medium that carries computer-readable code (e.g., software) including a set of instructions to cause performing, when executed by one or more processors, one of more of the methods described herein. Note that when the method includes several elements, e.g., several steps, no ordering of such elements is implied, unless specifically stated. The software may reside in the hard disk, hard drive, memory stick, flash memory card or like device, or may also reside, completely or at least partially, within the RAM and/or within the processor during execution thereof by the computer system. Thus, the memory and the, processor also constitute computer-readable carrier medium carrying computer-readable code.

Furthermore, a computer-readable carrier medium may form, or be included in a computer program product.

Note that while descriptions and diagrams may only refer to a single processor and a single memory that carries the computer-readable code, those in the art will understand that many of the components described above are included, but not explicitly shown or described in order not to obscure the inventive aspect.

The present systems may comprise a computer-readable carrier medium carrying a set of instructions, e.g., a computer program that is for execution on one or more processors, e.g., one or more processors. Thus, as will be appreciated by those skilled in the art, embodiments of the present invention may be embodied as a method, an apparatus such as a special purpose apparatus, an apparatus such as a data processing system, or a computer-readable carrier medium, e.g., a computer program product. The computer-readable carrier medium carries computer readable code including a set of instructions that when executed on one or more processors cause the processor or processors to implement a method. Accordingly, aspects of the present invention may take the form of a method, an entirely hardware embodiment, an entirely software embodiment or an embodiment combining software and hardware aspects. Furthermore, the present invention may take the form of carrier medium (e.g., a computer program product on a computer-readable storage medium) carrying computer-readable program code embodied in the medium.

The software may further be transmitted or received over a network via a network interface device. While the carrier medium is shown in an exemplary embodiment to be a single medium, the term "carrier medium" should be taken to include a single medium or multiple media (e.g., a centralized or distributed database, and/or associated caches and servers) that store the one or more sets of instructions. The term "carrier medium" shall also be taken to include any medium that is capable of storing, encoding or carrying a set of instructions for execution by one or more of the processors and that cause the one or more processors to perform any one or more of the methodologies of the present invention. A carrier medium may take many forms, including but not limited to, non-volatile media, volatile media, and transmission media.

Non-volatile media includes, for example, optical, magnetic disks, magneto-optical disks, flash drives, and the like. Volatile media includes dynamic memory, such as main memory. Transmission media includes coaxial cables, copper wire and fiber optics, including the wires that comprise a bus subsystem.

Transmission media also may also take the form of acoustic or light waves, such as those generated during radio wave and infrared data communications. For example, the term "carrier medium" shall accordingly be taken to included, but not be limited to, solid-state memories, a computer product embodied in optical and magnetic media; a medium bearing a propagated signal detectable by at least one processor of one or more processors and representing a set of instructions that, when executed, implement a method; and a transmission medium in a network bearing a propagated signal detectable by at least one processor of the one or more processors and representing the set of instructions.

It will be understood that the steps of methods discussed are performed in one embodiment by an appropriate processor (or processors) of a processing (i.e., computer) system executing instructions (computer-readable code) stored in storage. It will also be understood that the invention is not limited to any particular implementation or programming technique and that the invention may be implemented using any appropriate techniques for implementing the functionality described herein. The invention is not limited to any particular programming language or operating system.

It should be appreciated that in the above description of exemplary embodiments of the invention, various features of the invention are sometimes grouped together in a single embodiment, figure, or description thereof, for the purpose of streamlining the disclosure and aiding in the understanding of one or more of the various inventive aspects. This method of disclosure, however, is not to be interpreted as reflecting an intention that the claimed invention requires more features than are expressly recited in each claim. Rather, as the following claims reflect, inventive aspects lie in less than all features of a single foregoing disclosed embodiment. Thus, the claims following the Detailed Description are hereby expressly incorporated into this Detailed Description, with each claim standing on its own as a separate embodiment of this invention.

Furthermore, while some embodiments described herein include some but not other features included in other embodiments, combinations of features of different embodiments are meant to be within the scope of the invention, and form different embodiments, as would be understood by those skilled in the art. For example, in the following claims, any of the claimed embodiments can be used in any combination.

In the description provided herein, numerous specific details are set forth. However, it is understood that embodiments of the invention may be practiced without these specific details. In other instances, well-known methods, structures and techniques have not been shown in detail in order not to obscure an understanding of this description.

Thus, while there has been described what are believed to be the preferred embodiments of the invention, those skilled in the art will recognize that other and further modifications may be made thereto without departing from the spirit of the invention, and it is intended to claim all such changes and modifications as falling within the scope of the invention. For example, any formulas given above are merely representative of procedures that may be used. Functionality may be added or deleted from the block diagrams and operations may be interchanged among functional blocks. Steps may be added or deleted to methods described within the scope of the present invention.

The invention claimed is:

1. A lighting system configured to connect to a WiFi network accessible through a WiFi network identifier and password, the lighting system comprising:

a first lightbulb comprising:

a first set of light emitting elements;

a first WiFi module operable between a:

configuration mode, wherein the first WiFi module provides a lightbulb WiFi network and broadcasts a lightbulb WiFi identifier for accessing the lightbulb WiFi network, wherein the first WiFi module is configured to receive the WiFi network identifier and the password from a user device in the configuration mode, wherein the user device is connected to the lightbulb WiFi network using the lightbulb WiFi identifier; and a connected mode, wherein the first WiFi module is connected to the WiFi network using the WiFi network identifier and password, wherein the first WiFi module is configured to receive lighting instructions over the WiFi network in the connected mode;

a first processing system comprising non-volatile memory configured to store the WiFi network identifier and password received from the user device, the first processing system communicably coupled to the first set of light emitting elements and the first WiFi module, wherein the first processing system is configured to operate the first set of light emitting elements based on the lighting instructions received by the first WiFi module; and a first lightbulb casing substantially encapsulating the first set of light emitting elements, the first WiFi module, and the first processing system.

2. The lighting system of claim 1, wherein the first lightbulb casing encloses the first set of light emitting elements, the first WiFi module, and the first processing system.

3. The lighting system of claim 2, wherein the first WiFi module is incorporated into the first processing system.

4. The lighting system of claim 1, wherein the first processing system is a microprocessor or microcontroller.

5. The lighting system of claim 4 wherein the first set of light emitting elements comprises one or more light emitting diodes.

6. The lighting system of claim 5 wherein the first set of light emitting elements is configured to emit light of predetermined wavelengths.

7. The lighting system of claim 6, wherein the first set of light emitting elements comprises at least two light emitting elements configured to emit different light spectra, wherein the different light spectra mix to provide a predetermined light spectrum.

8. The lighting system of claim 7, further comprising a user computing device wirelessly connected to the lighting system and configured to control a lighting effect or a notification of the lighting system.

9. The lighting system of claim 8 wherein the lighting effect is light color.

10. The lighting system of claim 1, further comprising:

a second lightbulb comprising:

a second set of light emitting elements;

a second WiFi module configured to connect to the WiFi network with the WiFi network identifier and the password, and configured to receive the lighting instructions over the WiFi network when the second WiFi module is connected to the WiFi network;

a mesh network module configured to couple to a mesh network, the mesh network module operable between:

a slave mode, wherein the mesh network module is configured to receive the lighting instructions from the first lightbulb over the mesh network, wherein the second WiFi module is disconnected from the WiFi network in the slave mode; and a master mode, wherein the mesh network module is configured to transmit the lighting instructions to the first lightbulb, disconnected from the WiFi network, over the mesh network;

a second processing system comprising non-volatile memory configured to store the WiFi network identifier and password, the second processing system communicably coupled to the second set of light emitting elements, the second WiFi module, and the mesh network module, wherein the second processing system is configured to operate the second set of light emitting elements based on the lighting instructions; and a second lightbulb casing substantially encapsulating the second set of light emitting elements, the second WiFi module, the mesh network module, and the second processing system.

11. The lighting system of claim 10, wherein the mesh network module is further configured to transmit the lighting instructions to a third lightbulb, disconnected from the WiFi network, over the mesh network in the master mode.

12. The lighting system of claim 1, wherein the first WiFi module, in the connected mode, is configured to receive weather data retrieved from the Internet, and wherein the first processing system is configured to operate the first set of light emitting elements in response to the weather data satisfying a user-received condition of the lighting instructions.

13. The lighting system of claim 1, wherein the first WiFi module, in the connected mode, is configured to receive social network-derived data retrieved from the Internet, and wherein the first processing system is configured to operate the first set of light emitting elements in response to the social network-derived data satisfying a lighting condition of the lighting instruction.

14. The lighting system of claim 1, wherein the first processing system is configured to operate the first set of light emitting elements to emit a lighting notification in response to the first WiFi module entering the connected mode from the configuration mode.

15. The lighting system of claim 1, wherein the lighting instructions comprise a desired color input selected from a range of RGB colors presented at an application executing on the user device, wherein the first set of lighting elements comprise a red light emitting element, a green light emitting element, and a blue light emitting element, and wherein the first processing system is configured to individually operate the red, greed, and blue light emitting elements based on the desired color input.

16. A lighting system configured to connect to a WiFi network accessible with a WiFi network identifier and password, the lighting system comprising:

a first lightbulb comprising:

a first set of light emitting elements;

a first WiFi module operable between a:

configuration mode, wherein the first WiFi module provides a lightbulb WiFi network accessible through a WiFi lightbulb identifier and is configured to receive the WiFi network identifier and password from a user device connected to the lightbulb WiFi network using the lightbulb WiFi identifier; and a connected mode, wherein the first WiFi module is connected to the WiFi network using the WiFi network identifier and password, and is configured to receive lighting instructions over the WiFi network; and a first processing system communicably coupled to the first set of light emitting elements and the first WiFi module, wherein the first processing system is configured to operate the first set of light emitting elements based on the lighting instructions received at the first WiFi module.

* * * * *